US005271206A

United States Patent [19]

Tetenborg

[11] Patent Number: 5,271,206

[45] Date of Patent: Dec. 21, 1993

[54] METHOD FOR MAKING, FILLING, AND SEALING SACKS

[75] Inventor: Konrad Tetenborg, Lengerich, Fed. Rep. of Germany

[73] Assignee: Windmoller & Holscher, Lengerich, Fed. Rep. of Germany

[21] Appl. No.: 912,199

[22] Filed: Jul. 13, 1992

[30] Foreign Application Priority Data

Jul. 11, 1991 [DE] Fed. Rep. of Germany ..... 4122987
Sep. 24, 1991 [DE] Fed. Rep. of Germany ..... 4131810

[51] Int. Cl.[5] ..... B65B 43/42; B65B 43/56; B65B 57/04; B65B 3/26

[52] U.S. Cl. ..... 53/411; 53/131.5; 53/450; 53/504

[58] Field of Search ..... 53/411, 451, 450, 504, 53/77, 131.5, 131.4, 551, 552, 554, 555

[56] References Cited

U.S. PATENT DOCUMENTS 4,606,174 8/1986 Berg ..... 53/451
4,641,486 2/1987 Zannoni ..... 53/451 X
4,747,252 5/1988 Schulte ..... 53/451 X
4,784,697 11/1988 Bordini ..... 53/451 X
4,964,259 10/1990 Ylvisaker et al. ..... 53/451 X

FOREIGN PATENT DOCUMENTS 0429821 4/1991 European Pat. Off. .
3007246 9/1981 Fed. Rep. of Germany .

*Primary Examiner*—James F. Coan

[57] ABSTRACT

A method for repetitively making, filling and sealing sacks from a tubular web of thermoplastic material preferably provided with side folds, wherein, for each sack, the leading end of the tubular web is provided with a transverse weld, and from the tubular web a section constituting an open sack is cut off, and where the sack is then filled and the open side of the sack is closed by means of a transverse weld. To ensure that the filled sacks are always filled tight and full, during the filling of the sack, there is detected by means of a measurement pick-up to what level the sack is filled when filling with a certain quantity of filling material, and that in accordance with the filling level of the sack the length of the tubular web section forming the sack is adjusted.

7 Claims, 5 Drawing Sheets

METHOD FOR MAKING, FILLING, AND SEALING SACKS

BACKGROUND OF THE INVENTION

This invention relates to a repetitive method for making, filling and sealing sacks from a tubular web of thermoplastic material, preferably provided with side folds, wherein, for each sack, the leading end of the tubular web is provided with a transverse weld, and from the tubular web a section constituting an open sack is cut off, and wherein the sack is then filled and the open side of the sack is closed by a transverse weld.

Such methods are known in the prior art. For instance, the sections that will later on constitute the sack are withdrawn from a tubular chain in accordance with a known method. Said tubular chain is perforated at predetermined distances, so that the sections corresponding to the future sack can accordingly be torn off along the perforations. After closing the bottom weld, the individual tube sections are supplied to a charging funnel to be filled for instance with granular material. When a predetermined quantity of the filling material has been filled in, the open sacks are removed, are pulled taut on their open side, and are sealed in a specially provided trimming means.

The generic method can, for example, be carried out by means of an apparatus in accordance with the DEOS 37 15 685. This apparatus comprises sliding and advancing rollers, by means of which successive leading ends of the tubular film web each provided with a transverse weld are intermittently pushed in vertical direction freely hanging down, by one length of bag or sack each, between welding jaws of a welding device, which make opening and closing movements in a horizontal plane. Below said welding jaws a transverse cutting means is disposed, and below said transverse cutting means grippers arranged in pairs on a transport means are provided, which supply the hanging bags or sacks cut off from the tubular film web and provided with bottom welds in horizontal conveying direction via a cooling line for cooling the transverse welds to a transfer means transporting the same to a filling station. The transport means consists of a hub-like supporting member, which is pivotally mounted about a vertical axis, with radial arms at whose free ends the grippers arranged in pairs are provided. The cooling line consists of a cooling carrousel for supplying the sack workpieces, which were provided with the transverse welds and were cut off from the tubular web, from the welding station on a circular path to a means for transferring the sack workpieces to the filling station. When this apparatus comprises, for instance, four radial arms, there is provided above the first station a welding means as well as a cutting means. In accordance with this prior art each cycle of making a sack comprises the steps of introducing from the top a sack already provided with a transverse weld into the first pair of open grippers, and seizing and cutting off the same after it has been advanced by one length of sack. Then, a new transverse weld is formed at the end of the tubular web, while the cooling carrousel intermittently rotates by about an angle of 90° and remains in this position until a further sack provided with a transverse weld has been introduced in the succeeding station. In a four-arm cooling carrousel this is repeated until the first station has rotated by 270° in three cycles. At this point the transverse weld has cooled and the sack is transferred to a transfer means for transporting the sack to a filling station, where after filling the sack a further transverse weld is made for sealing the filled sack, after the open end of the sack has been pulled taut.

In the filling station the sack is filled with a predetermined quantity of filling material, where in general a predetermined weight of filling material is filled in. However, the filling material, for instance a granular material to be filled in, many have different bulk volumes with the same weight. This is, for instance, due to a different moisture content of the bulk material. Due to the different filling levels it can now occur that the sack, after it has been sealed by the transverse weld, has an undesired clearance between the same and the filling material. This means that the sacks are not filled tight, which is in particular disadvantageous in the further handling of the sacks.

This disadvantage is eliminated in the first mentioned method by a corresponding vertical adjustment of the trimming means, which must be made by the machine attendant. This means that the corresponding welding jaws are adjusted in accordance with the current bulk density or the resulting bulk volume of the bulk material. Again, this leads to the fact that in the apparatuses carrying out this method there must always be present a machine attendant for monitoring or adjusting the apparatus.

When carrying out the generic method by means of an apparatus in accordance with the DE-OS 37 15 685 there is in addition the problem that an adjustment of the trimming means disposed in the apparatus is not provided, so that depending on the bulk density of the filling material the sacks are—as desired—filled tight or are, however, filled with an undesired amount of excess air between the filling material and the sealing transverse weld.

SUMMARY OF THE INVENTION

It is an object of the present invention to develop the generic method such that it is ensured that all sacks can automatically be filled tight and full, i.e. without undesired dead volume.

In accordance with the invention, proceeding from the generic method, this object is solved in that during the filling of the sack it is detected by means of a measurement pick-up to what level the sack is filled when filling in a certain quantity of the filling material, and that corresponding to the filling level of the sack the length of the formed tubular film web sections is varied. The present invention is based on the knowledge that the bulk properties of the filling material do not change abruptly. So, when by means of the measurement pick-up, designed as a sensor or optical measurement pick-up, it is detected that due to a change of the bulk density the bulk volume of the filling material has changed, this measurement signal is supplied to a central processing unit, from where the sliding and advancing rollers of the apparatus advancing the tubular film web are driven such that the intermittently removed length of the tubular film web sections is adjusted to the respective filling level of the filling material in the sack. This means that the tubular film web section constituting the sack, which is already provided with the bottom weld and is supplied to the filling device, is longer or shorter depending on the filling level of the filling material.

When the tubular film web is printed in scattered print, the advancing length of the advancing cycle of the tubular film web can automatically be varied proportionally in accordance with the filling level signal detected by the measurement pick-up, as it is not decisive here whether or not the print applied onto the tubular film web is cut through when cutting the sack sections.

When corners are welded together with the cutting and forming of transverse welds, as this is known for instance from the EP-A 00 21 463, the corner welding tool must likewise be automatically adjusted proportionally in accordance with the filling level signal detected by the measurement pickup.

When the tubular film web is now printed in format print, the method in accordance with the invention is advantageously constituted in that after making the transverse weld sealing the sack the tubular film web is intermittently advanced up to a printed mark, that the section constituting the sack is cut off by means of a separating cut without simultaneous formation of the transverse weld sealing the succeeding tubular film section, that the succeeding tubular film web is again advanced by a comparatively short automatically adjustable length, and that alternatively the advanced section of the tubular film web is cut off again, where at the same time there is possibly formed the transverse weld sealing the succeeding tube section. In this way, the length of the sack section of the resulting filling level is on the one hand adapted to the specified quantity of the filling material when the same is filled in. On the other hand, it is advantageously prevented that by varying the length of the respectively formed tubular film web section the tubular film web is cut through at a printed point. It is decisive that the tubular film web is always advanced up to a printed mark at the opening edge of the sack to be cut off, that it is cut off then, and that then corresponding to the length of the section to be formed the bottom weld of the succeeding section is varied in accordance with the filling level signal of the measurement pick-up. Depending on the filling level of the filling material a tubular film section a few centimeters long is formed, which can then each be collected separately and recycled.

In accordance with a further form of this preferred embodiment for tubular film webs printed in format print, this above-described intermediate advancing of the tubular film web after cutting off the sack section can be set at zero for the case that the bulk material reaches its minimum bulk density to be expected and thus a maximum filling level. This is the case, for instance, in the completely dry condition of a granular material to be filled in. In this case, when the leading sack section is cut off, the transverse weld of the succeeding sack section can be formed at the same time, as here the maximum available length of the tubular film web section is utilized.

When in the above described preferred embodiment of the method, where the tubular film web is printed in format print, there is likewise provided a welding of corners, it should be considered that in this case the corners of the opening edge of the leading bag and the corners at the bottom weld of the succeeding bag section cannot simultaneously be made with one tool, as this is for instance easily possible in a tubular film web with scattered print. Therefore, in accordance with this embodiment of the method the welding of corners at the opening edge of the sack section is made together with the separating cut, and the welding of corners at the bottom seam is made together with the formation of the transverse weld. This requires a separate tool for the welding of corners at the opening edge and the welding of corners at the bottom seam. For the case that the intermediate advancing is set at zero, both tools are simultaneously moved towards the tubular film web.

By means of the corner welding tools the corner welds can also be made together with the second transverse weld, and the distance between the corner welding tools can then be readjusted manually or automatically.

DESCRIPTION OF PREFERRED EMBODIMENT

Figure 2:
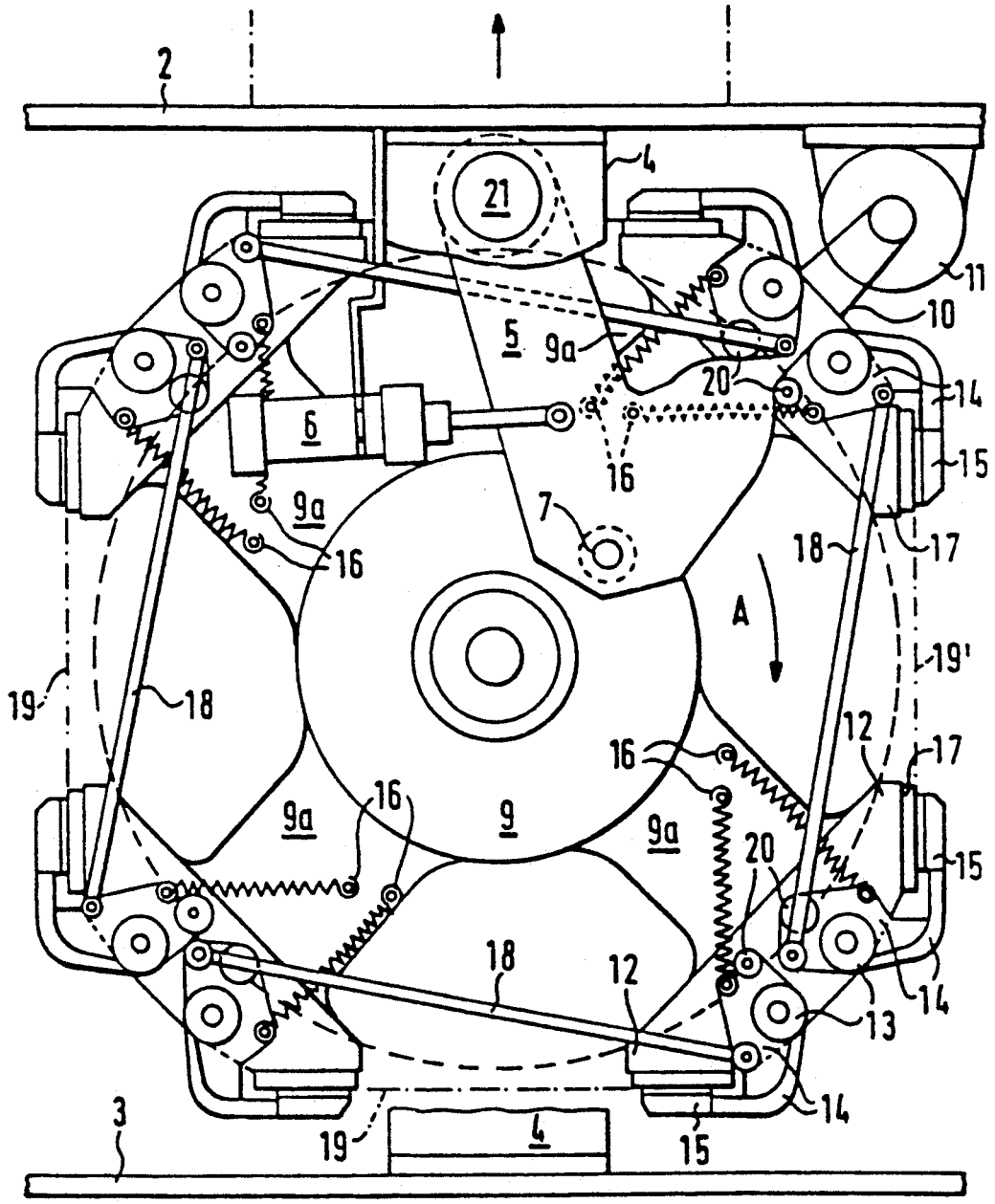
FIG. 2 is a section on line II—II in FIG. 1.

A machine frame 1 comprises side walls 2 and 3, which are indicated in FIG. 2. The side walls 2, 3 are connected with each other by crossbar 4. Said crossbar 4 is about centrally provided with a downwardly extending fixed axis 21, on which in the vicinity of the crossbar 4 a swivel arm 5 is mounted, which by means of a fluid piston cylinder unit 6, whose cylinder is stationarily held by a supporting member, can be moved in one of two possible end positions.

Figure 5:
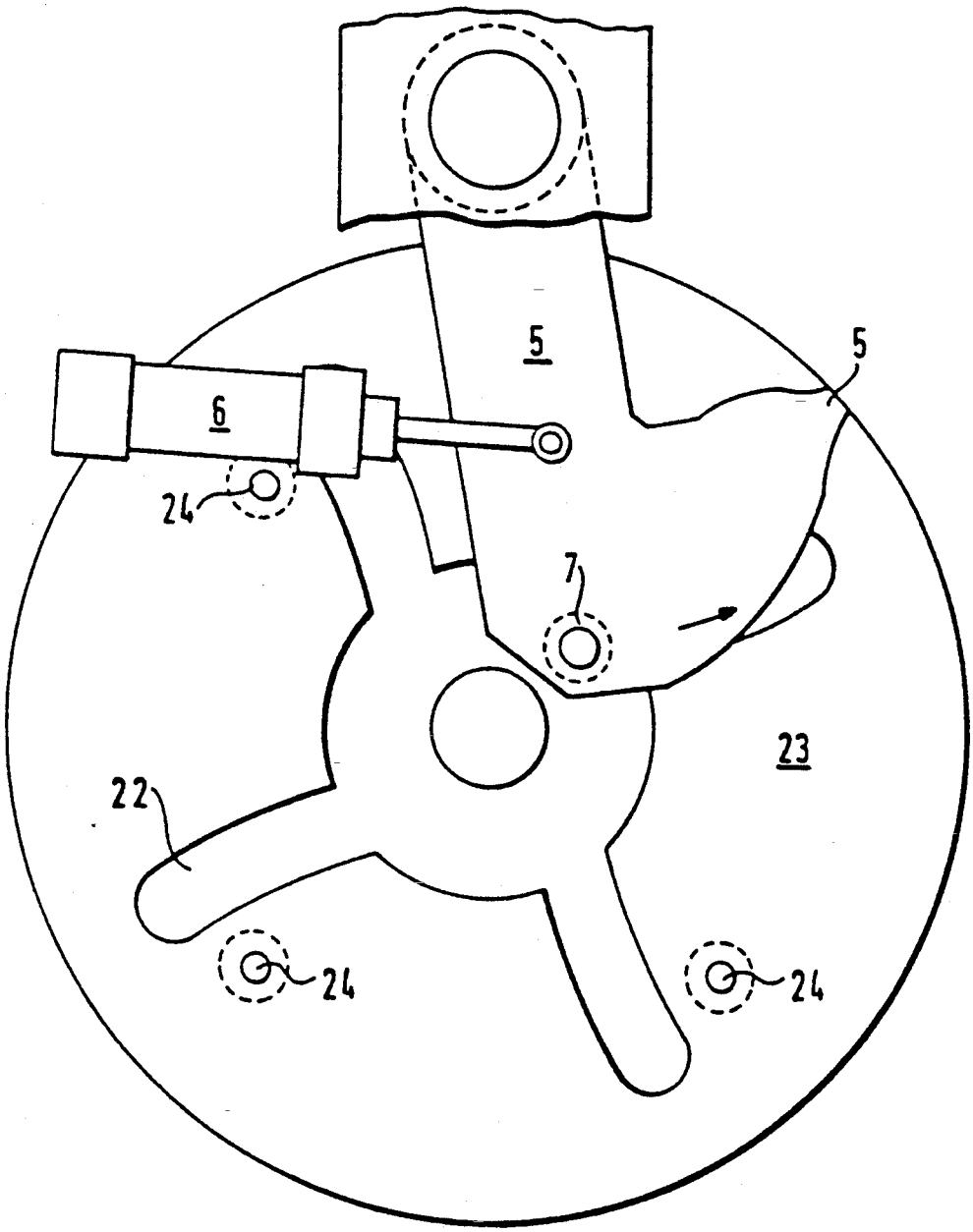
FIG. 5 is a plan view of the locking plate shown in FIG. 4.

In FIG. 5 it can be seen that the swivel arm 5 designed as angle lever carries a shaped part 5' at its free end, and in its angle portion is provided with a retaining roller 7. The function of these parts will be discussed further below in the description.

Furthermore, to the crossbar 4 a further vertical axis 8 is attached, which below the swivel arm 5 carries a four-arm rotary table 9, which by means of a toothed belt 10 can be intermittently rotated by a motor 11 by 90° each. The direction of rotation of the rotary table is indicated in FIG. 2 by an arrow A.

From FIG. 2 it can be seen that the rotary table 9, constituting a hub, has freely protruding arms **9*a* with shaped outer parts 12 each provided with two upwardly projecting pins 13. Pivotally mounted about each pin 13 is a lever 14, which at its free end constitutes a gripper 15. Each of said grippers 15 rests against an abutment surface 17 by the force of the springs 16, with each shaped part being provided with two abutment surfaces 17. By one connecting rod 18 the levers 14 facing each other of two adjacent arms 9*a* are functionally connected with each other such that the two associated grippers 15 open or close simultaneously, so as to be able, for instance, to seize and hold a sack 19** therebetween.

The grippers 15 are opened by the wedge- or curve-shaped cam surfaces of the shaped part 5' of the supporting arm 5. When the supporting arm 5 is swivelled by extending the piston rod of the fluid piston cylinder unit 6, the shaped part 5' urges apart the pressure rollers 20 of the shaped part 12 connected with the levers 14, so that the grippers 15 swivel about the pins 13 and move away from the associated abutment surfaces 17. By means of the connecting rods 18 the grippers 15 of adjacent shaped parts are released at the same time. In the position represented in FIG. 2 the gripper units 15 pointing to the upper edge of the drawing and those pointing to the right edge of the drawing would thus be released upon actuation of the fluid piston cylinder unit 6.

To ensure that in the case of an undesired starting of the motor 11 the protruding shaped part 5' does not cause any damage, the retaining roller 7 mounted in the angle portion of the swivel arm 5 moves into a guiding groove 22 of a locking plate 23 when the swivel arm is swivelled for opening the grippers. Said locking plate 23 is firmly connected with the rotary table 9 by means of screw bolts 24, so that said rotary table is prevented from rotating by the retaining roller 7 of the swivel arm 5, namely as long as the shaped part 5' is present between the rollers 20 of a shaped part 12.

Figure 1:
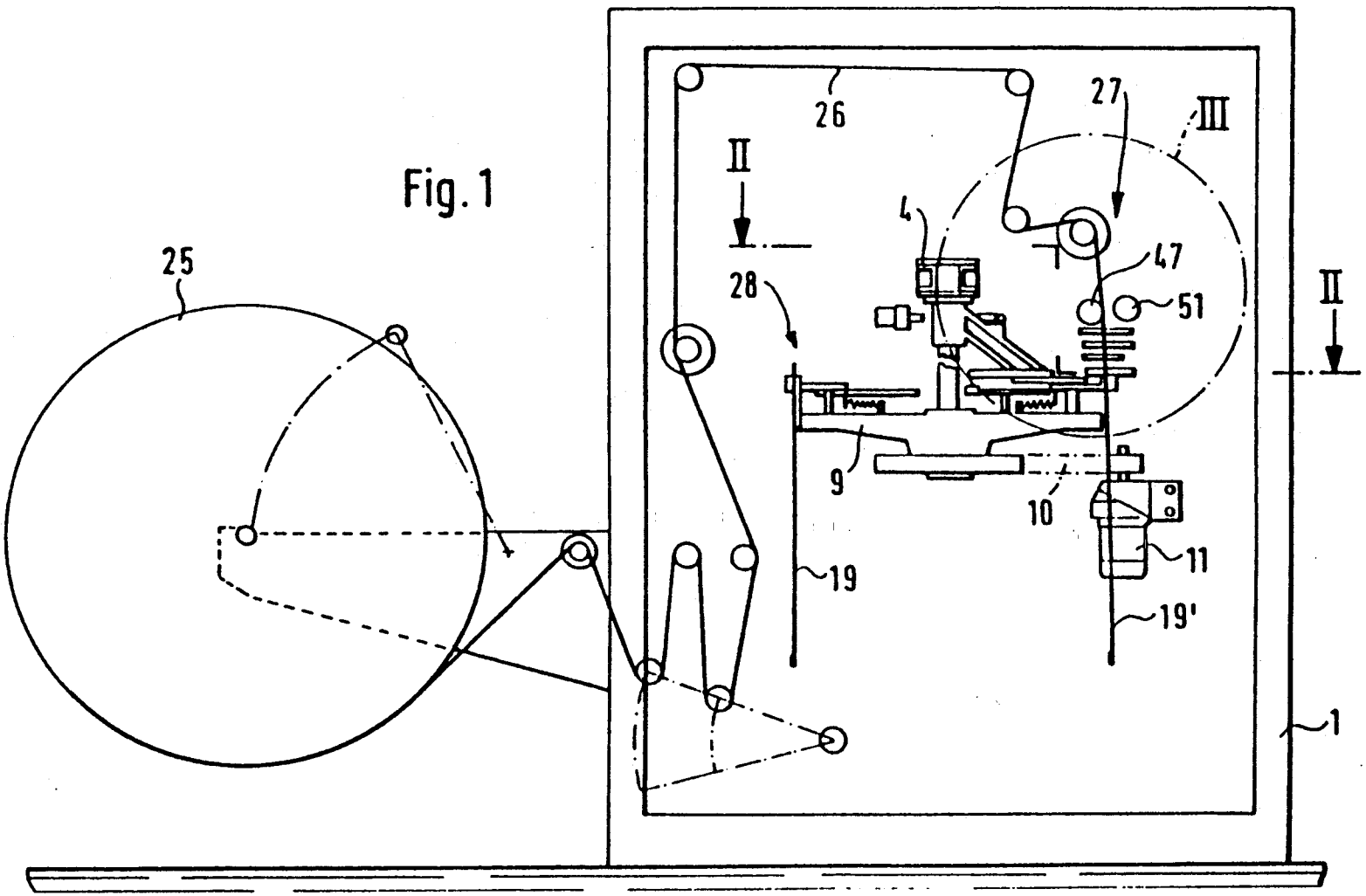
FIG. 1 is a schematic side view of an apparatus for carrying out a method in accordance with the invention for making bags or sacks, which includes a cooling carrousel.
Figure 3:
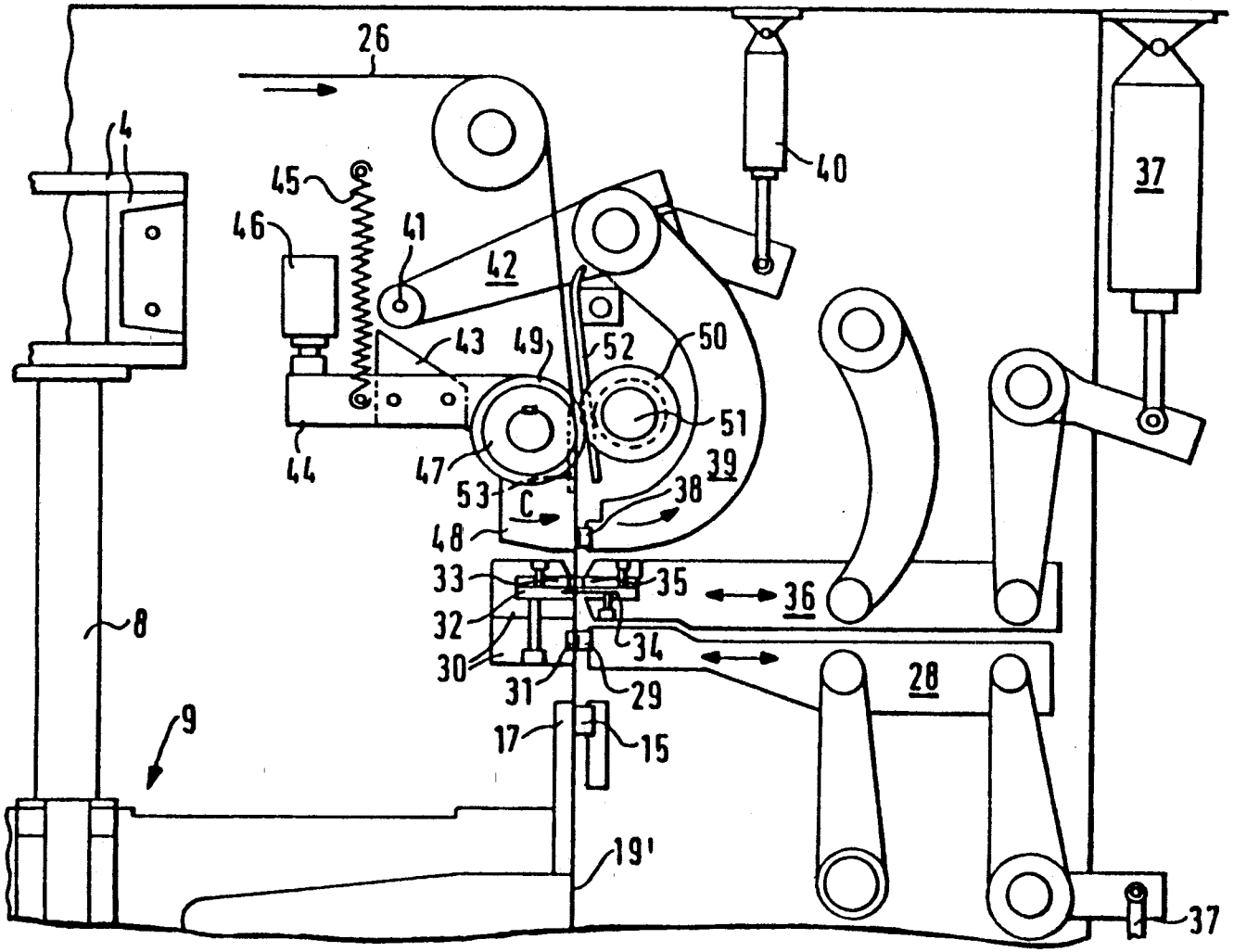
FIG. 3 is an enlarged view of the portion circled with a dash-dotted line in FIG. 1.
Figure 4:
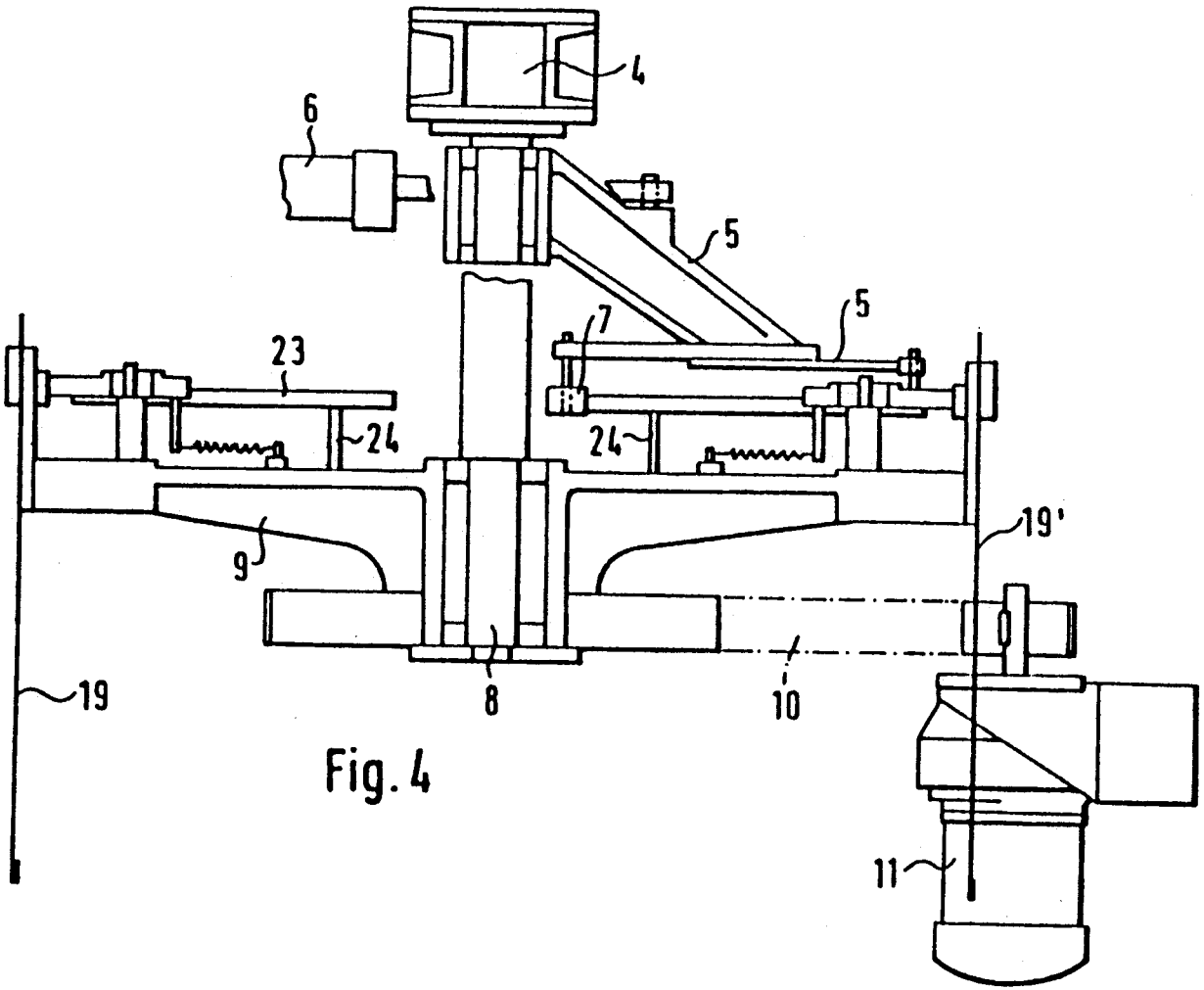
FIG. 4 is an enlarged view of the middle portion of the apparatus shown in FIG. 1.

From FIG. 1 it can be seen that from a roller 25 a tube 26 is introduced from the top into an inlet station 27. Said inlet station 27 is stationarily connected with the framelike support 1 and is represented in detail in FIG. 3. FIG. 3 shows the central axis 8 of the cooling carrousel and a part of the rotary table 9. Clamped between the grippers 15 and the abutment surfaces 17 of the rotary table 9 is a tube section 19 provided with a bottom seam, which is, however, still connected with the tubular web 26. Above the grippers 15 and 17 there is provided a coupling rod 28 guided in parallel on connecting rods, which at its end facing the web 26 carries a clamping strip 29, which cooperates with a counter-strip 31 fixed in a stationary support 30. In addition to the counter-strip 31 the support 30 comprises a knife receiving groove 32 as well as a welding jaw 33. For cutting off the sack 19 from the tubular web 26 a knife 34 enters into the knife receiving groove 32, while a second welding jaw 35 cooperates with the welding jaw 33 for providing the leading end of the tubular web 26 with a transverse weld.

If the tubular web 26 is printed in scattered print, the length of each advancing cycle to be set is varied as follows. By means of a measurement pick-up not represented here—for instance a sensor—, which is disposed at the filling device, a measurement signal indicative of the respective filling level of the filling material is processed by a central processing unit such that the intermittently advanced length of the tubular film web is adjusted in accordance with the bulk density of the filling material. For forming the bottom weld the welding jaw 33 is then attached to the tubular web 26 together with the knife 34, so that at the same time the separating cut against the preceding sack section is made.

If the tubular web 26 is now printed in format print, it is important that the print is not cut through when the tube sections are formed. Therefore, the tubular web is advanced intermittently by means of a printed mark provided at the opening edge of the respective sack. Changing the length of the sack section is now effected in accordance with the measurement signal detected by the measurement pick-up, in that a longer or shorter strip between the opening edge of the bag section and the bottom weld of the succeeding sack section is cut off. These tubular web sections cut off can then be collected and recycled. When making the separating cut at the opening edge the knife 34 is applied to the tubular web 26 without the welding jaw 33. Having advanced the web by the intermediate section to be cut off, the knife 34 is again applied to the tubular web 26, but this time together with the welding jaw 33. Thus, the cut for separating the intermediate section and the formation of the transverse weld of the succeeding sack section are effected at the same time.

Above the welding jaws 33 and 35 a further clamping means is provided for clamping the tubular web 26. The same consists of a swivelling lever 39 provided with a clamping strip 38, which can be moved by means of a fluid piston cylinder unit 40. Firmly connected with the swivelling lever 39 is an arm bearing a roller 41, where the roller 41 in the clamping position of the swivelling lever 39 is disposed at a distance from a guide member 43. Said guide member 43 is connected with a lever 44, which is held in engagement with a stop 46 by means of a spring 45. The pivot of the lever 44 lies on the axis of the advancing roller 47. It has a downwardly pointing projection, which constitutes a counterpart 48 for the clamping strip 38. For releasing the clamping, after forming a bottom seam and making a separating cut, there are first of all actuated the fluid piston cylinder units 37 and 40, and as a result the coupling rods 28, 36 as well as the lever 39 are swivelled away. During this movement the roller 41 gets in contact with the cam surface of the guide member 43. This leads to a swivelling of the counterpart 48 in the direction of arrow C, so that on the one hand the end of the web 26 freely hanging down is released from the welding jaw 33 and is deflected on the other hand. Due to this deflection it is ensured that the web does not collide with the support 30, when in the next cycle it is advanced by the advancing rollers 47 and 51 by one length of sack.

To furthermore prevent the web 26 from wrapping around the advancing rollers 47 and 41, the advancing rollers are provided with annular grooves 49, 50 in which engage stripping fingers 52 and 53. Of these fingers, the fingers 52 are stationarily held, and the fingers 53 are attached to the counterpart 48 as stripping rakes.

I claim:

1. A method for repetitively making, filling and sealing sacks from a tubular web of thermoplastic material wherein, for each sack, a leading end of the tubular web is provided with a transverse weld, and from the tubular web a section constituting an open sack is cut off, and wherein the sack is then filled and the open side of the sack is closed by a transverse weld, characterized in that during filling of a sack a measurement pick-up is used to detect to what level the sack has been filled with a predetermined quantity of filling material, and that corresponding to the filling level of the sack the length of the tubular web section forming the sack is adjusted, characterized in that the web is printed in a scattered print and an advancing length of an advancing cycle of the web is automatically varied in accordance with the filling level detected by the measurement pick-up.

2. The method according to claim 1 which includes welding corners of the sections constituting the sacks, characterized in that a corner welding tool is controlled automatically in accordance with the filling level detected by the measurement pick-up.

3. A method for repetitively making, filling and sealing sacks from a tubular web of thermoplastic material wherein, for each sack, a leading end of the tubular web is provided with a transverse weld, and from the tubular web a section constituting an open sack is cut off, and wherein the sack is then filled and the open side of the sack is closed by a transverse weld, characterized in that during filling of a sack a measurement pick-up is used to detect to what level the sack has been filled with a predetermined quantity of filling material, and that corresponding to the filling level of the sack the length of the tubular web section forming the sack is adjusted, characterized in that the tubular web is printed in format print, that after the formation of the transverse weld closing the sack, the tubular film web is intermittently advanced up to a printed mark, that the section constituting the sack is cut off by means of a separating cut without simultaneously forming the transverse weld closing the succeeding tube section, that the succeeding tubular film web is again advanced by a comparatively short adjustable length, that alternatively the advanced section of the tubular film web is again cut off, and that there is formed the transverse weld closing the succeeding tube section.

4. The method according to claim 3 with an additional welding of corners of the sections constituting the sacks, characterized in that the welding of corners as the opening edge of the sack section and at the bottom seam is each made by means of a separate corner welding tool.

5. The method according to claim 4, characterized in that the intermediate advance of the tubular film web can be set at zero after the sack section has been cut off, and that then when the sack section is cut off, there is simultaneously formed the transverse weld of the succeeding sack section.

6. The method according to claim 4, characterized in that the welding of corners at the opening edge of the sack section is made together with the separate cut, and that the welding of corners at the bottom seam is made together with the formation of the transverse weld.

7. The method according to claim 4, characterized in that the distance between the separate corner welding tools is readjusted automatically.

* * * * *